United States Patent [19]

Charmley et al.

[11] 4,193,948

[45] Mar. 18, 1980

[54] MOUNTING STRUCTURE FOR PLASTIC CARBURETORS

[75] Inventors: Richard P. Charmley, Caro; William A. Scott, Cass City, both of Mich.

[73] Assignee: Walbro Corporation, Cass City, Mich.

[21] Appl. No.: 972,777

[22] Filed: Dec. 26, 1978

[51] Int. Cl.[2] ..... F02M 19/00

[52] U.S. Cl. ..... 261/65; 261/DIG. 68; 285/208; 285/305

[58] Field of Search ..... 261/65, DIG. 68; 123/52 M; 285/305, 208, 189, 205

[56] References Cited

U.S. PATENT DOCUMENTS

| | | | |
|---|---|---|---|
| 2,549,791 | 4/1951 | Fletcher | 285/305 |
| 2,699,915 | 1/1955 | Goepfrich | 285/305 |
| 2,917,267 | 12/1959 | Riddle | 285/205 |
| 3,076,627 | 2/1963 | Huron | 285/189 |
| 3,084,958 | 4/1963 | Appleton | 285/189 |
| 3,512,808 | 5/1970 | Graham | 285/205 |
| 3,744,612 | 7/1973 | Geis | 285/189 |
| 3,869,153 | 3/1975 | Vincent et al. | 285/189 |
| 3,975,468 | 8/1976 | Tuckey | 261/65 |
| 4,054,306 | 10/1977 | Sadoff, Jr. et al. | 285/305 |
| 4,139,580 | 2/1979 | Tuckey et al. | 261/DIG. 68 |

*Primary Examiner*—Tim R. Miles

*Attorney, Agent, or Firm*—Barnes, Kisselle, Raisch & Choate

[57] ABSTRACT

A retainer for plastic carburetors which eliminates the necessity for mating flanges bolted together and thus avoids distortion of the body due to clamping pressures. The carburetor body has male parts which insert into recesses in an engine block or heat dam to seal in relation thereto and a forked clamp embraces a necked portion of the carburetor body and is clamped in cantilever fashion so that the plastic body is retained securely without distortive forces.

6 Claims, 5 Drawing Figures

MOUNTING STRUCTURE FOR PLASTIC CARBURETORS

FIELD OF INVENTION

Carburetors for small engines, particularly plastic carburetors and a mounting structure for removably retaining the carburetor body on an engine body.

BACKGROUND OF INVENTION

Carburetors for engines have been made of metal, especially die cast metals, and the usual method of attachment to the engine has been a flange formed on the carburetor body and the carburetor with metal screws and lock washers holding the flanges together with a suitable sealing gasket between the flanges.

There is, of course, a tremendous vibration problem in connection with the use of carburetors and this is amplified by orders of magnitude in small engines used on power lawn mowers, snowmobiles, chain saws and the like. A further complication results from the confined housings in many of these small engine applications where heat develops near the carburetor.

Within the past few years, there has been a trend toward the use of plastic carburetor bodies and after many trials, some plastics have been developed which resist attack by the hydrocarbons used as fuel and which are sturdy enough to stand up under the vibration loads.

Plastic, however, has a tendency to deform gradually under pressure, and the use of a standard flange, as previously used, has proved unsatisfactory because the tight screw pressure initially acceptable tend to gradually deform the plastic part until it loosens or distorts so that a throttle valve may eventually bind in a deformed plastic housing.

In addition, it is important to prevent heat transfer from an engine to a carburetor to avoid excessive vaporization of the fuel which may alter the function after calibration for liquid fuel.

OBJECTS OF THE PRESENT INVENTION

It is, therefore, an object of the present invention to provide a fastening structure for plastic carburetors which will secure the carburetor body to the engine while avoiding stressing pressures on the plastic which would tend to loosen or cause distortion.

It is a further object to provide a carburetor fastening structure which is readily assembled and removed and which is economical to manufacture.

Other objects and features of the invention will be apparent in the following description and claims in which the principles of the invention are set forth together with a detailed description to enable a person skilled in the art to practice the invention, all in connection with the best mode presently contemplated.

DETAILED DESCRIPTION OF THE INVENTION

Figure 1:
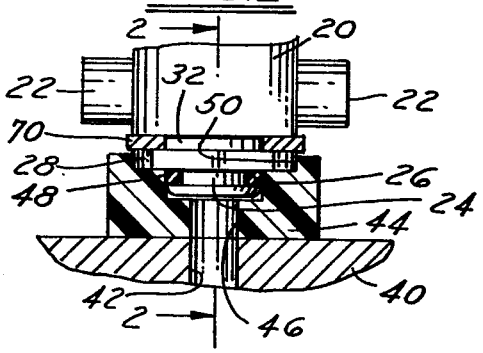
FIG. 1, a view of an assembly, partially in section, showing the carburetor body and the engine mount, taken on line 1—1 of FIG. 2.

In FIG. 1, a view of a carburetor engine assembly is illustrated, the molded plastic carburetor body 20, which contains a throttle valve, not shown, has trunnions 22 which will mount a throttle valve control shaft. The body has a neck portion 24 carrying an O-ring 26 behind which is an acircular orientation plate 28 having opposed, flat parallel edges 30. The carburetor body is preferably molded from a dense plastic material which is resistant to hydrocarbons such as nylon or Teflon.

Between the acircular plate 28 and the body of the carburetor is a necked-down portion 32 which forms an annular space or groove.

An engine body 40 has a fuel-air mixture inlet opening 42 around which is a heat dam collar 44 formed of a dense non-conducting plastic and having also a fuel-air passage 46 in registry with opening 42 in the engine. See FIG. 2.

Passage 46 in the heat dam opens into stepped recesses 48 and 50. Circular recess 48 is dimensioned to receive neck portion 24 and the O-ring 26 on the carburetor in a sealed fit. Recess 50 is shaped to receive the oval plate 28 in assembly and thus prevent the carburetor from turning when assembled in position.

The heat dam block or collar 44 (FIG. 3) made of a dense plastic, such as a nylon composition, is fastened securely to the engine block by screws 60. This dam has an ovoid shape in outline and at one end on the outer face has a flat riser 62, the function of which will be described later.

Figure 4:
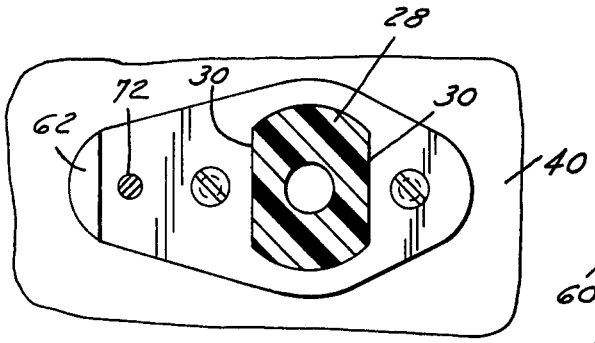
FIG. 4, a sectional view on line 4—4 of FIG. 2.

A forked retainer plate 70 (see FIG. 4) has an apertured bight portion to receive a shank of a retainer bolt 72 and two legs which are spaced to straddle the neck portion 32 and to locate in the spaced grooves between plate 30 and the carburetor housing 20. A nut 74 is located in a recess 76 aligned with bolt 72 and can be pressed into the recess so that it is self retaining. In this way, the bolt 72 can be inserted into the bolt hole and screwed into the nut from the outside of heat dam block or collar 44.

Figure 2:
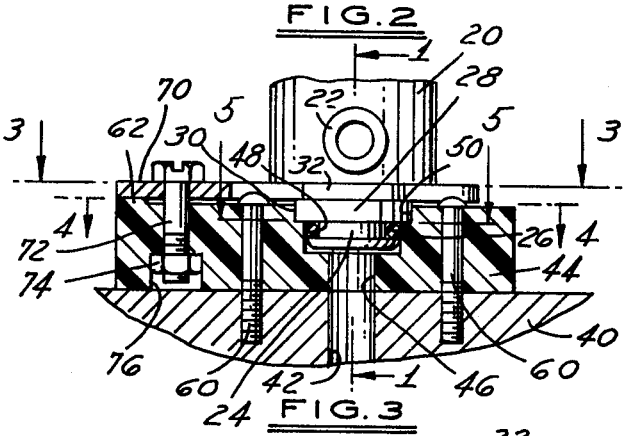
FIG. 2, a sectional view on line 2—2 of FIG. 1.
Figure 3:
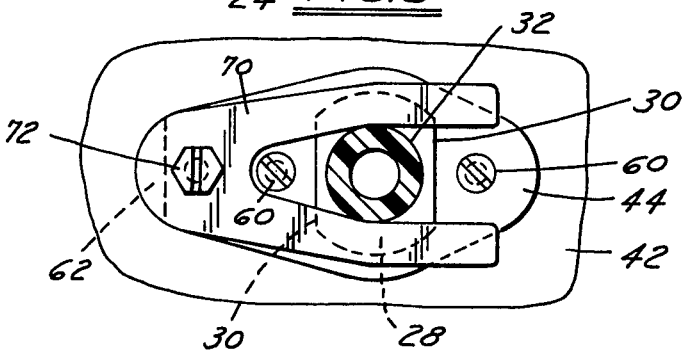
FIG. 3, a sectional view on line 3—3 of FIG. 2.

As shown in FIGS. 2 and 3, in assembly, the heat dam 44 is secured to the engine block by screws 60. The legs of the forked plate 70 can be straddled over neck 32 of the carburetor and the portions 24 and 28 inserted into the respective stepped recesses 48 and 50. This will locate the plastic carburetor securely in the heat dam. Screw 72 is then passed through the plate 70 and tightened into nut 74. The plate will fulcrum on the riser 62 at the bight end and tightening the screw will cause the forked ends to press on plate 28 to force it into the recesses.

Figure 5:
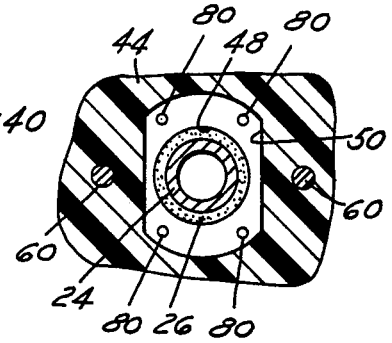
FIG. 5, a sectional view on line 5—5 of FIG. 2.

As shown in FIG. 5, it is preferable that the flat inner wall of the recess 50 have three, or possibly four, small raised protuberances 80 to contact the face of the oval insert plate 28. This will prevent rocking of the carburetor body and eliminates the necessity for absolute flatness in the facing surfaces.

While the invention has been described in conjunction with a heat dam which insulates the carburetor from the metallic engine body, it could, in some instances, be applied directly to an engine body provided with suitable recesses to receive the carburetor parts.

What we claim is:

1. A carburetor retention device for plastic carburetors to eliminate body distortion which comprises:

(a) a carburetor body having spaced recesses formed therein adjacent a surface to be mounted to an engine, (b) a forked elongate clamp having legs to seat in and straddle said recesses and having a portion spaced from said legs adapted to be fastened adjacent an engine to retain said carburetor through the pressure of said legs on said body, and (c) an acircular projection on said body to be received in a complemental recess to stabilize the carburetor body against turning.

2. A carburetor retention device as defined in claim 1 in which said carburetor body has a fuel-air outlet neck portion to be received in sealing relation to a fuel-air receiving inlet of an engine, and a shoulder behind said projection spaced from said body to provide said spaced recesses.

3. A carburetor retention device as defined in claim in which said projection is a plate acircular in shape and adapted to be received in said complemental recess to stabilize the carburetor against turning.

4. A carburetor retention device for plastic carburetors to eliminate body distortion which comprises:

(a) a carburetor body having spaced recesses formed therein adjacent a surface to be mounted to an engine, (b) a forked elongate clamp having legs to seat in and straddle said recesses and having a portion spaced from said legs adapted to be fastened adjacent an engine to retain said carburetor through the pressure of said legs on said body, (c) a heat dam block secured to an engine block having recesses therein, (d) projections on said body to be received in said recesses including an acircular plate, and (e) spaced protuberances on the base of a recess receiving one of said projections to contact an exposed surface of said one of said projections to stabilize said body against rocking.

5. A carburetor retention device for plastic carburetors to eliminate body distortion which comprises:

(a) a carburetor body having spaced recesses formed therein adjacent a surface to be mounted to an engine, (b) a forked elongate clamp having legs to seat in and straddle said recesses and having a portion spaced from said legs adapted to be fastened adjacent an engine to retain said carburetor through the pressure of said legs on said body, (c) means on an engine having stepped recesses surrounding a fuel-air inlet passage, and (d) stepped projections on said body adapted to fit said recesses, at least one of said projections being sealed in a recess to seal said fuel-air inlet passage, and at least one of said projections being acircular in a complemental recess to prevent turning of said body.

6. A carburetor retention device for holding plastic carburetors on an engine mount to eliminate body distortion which comprises:

(a) a carburetor body having an outlet passage in a circular sealing projection to be received in sealing relation in a complemental recess in an engine mount, (b) spaced shoulder means on either side of said projection spaced from but facing toward said carburetor body and located between said body and said circular sealing projection, (c) a forked elongate clamp having legs to bear respectively on said spaced shoulder means straddling said passage and having a bight portion connecting said legs spaced from said passage and adapted to be fastened adjacent an engine to create pressure on said shoulders toward said engine mount, and (d) stabilizing means on said body to engage a portion of said engine mount to prevent rotation of said body and said projection relative to an engine on which said body is mounted.

* * * * *

UNITED STATES PATENT AND TRADEMARK OFFICE

CERTIFICATE OF CORRECTION

PATENT NO. : 4,193,948

DATED : March 18, 1980

INVENTOR(S) : Richard P. Charmley and William A. Scott

It is certified that error appears in the above-identified patent and that said Letters Patent are hereby corrected as shown below:

Column 3, Line 18, after "claim" insert -- 2 --.

Signed and Sealed this

*Eighth* Day of *July 1980*

[SEAL]

*Attest:*

SIDNEY A. DIAMOND

*Attesting Officer*

*Commissioner of Patents and Trademarks*